US010750275B2

(12) United States Patent
Tanaka

(10) Patent No.: US 10,750,275 B2
(45) Date of Patent: Aug. 18, 2020

(54) SPEAKER DEVICE AND CONTROL METHOD FOR A SPEAKER DEVICE

(71) Applicant: DENSO TEN Limited, Kobe-shi, Hyogo (JP)

(72) Inventor: Keiichiro Tanaka, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 16/132,579

(22) Filed: Sep. 17, 2018

(65) Prior Publication Data

US 2019/0124439 A1 Apr. 25, 2019

(30) Foreign Application Priority Data

Oct. 24, 2017 (JP) ..... 2017-205652

(51) Int. Cl.

| | |
|---|---|
| ***H04R 1/32*** | (2006.01) |
| ***B06B 1/06*** | (2006.01) |
| ***H04R 3/00*** | (2006.01) |
| ***H04R 17/00*** | (2006.01) |

(52) U.S. Cl.

CPC ..... *H04R 1/323* (2013.01); *B06B 1/06* (2013.01); *B06B 1/0607* (2013.01); *H04R 3/00* (2013.01); *H04R 17/00* (2013.01); *H04R 2217/03* (2013.01); *H04R 2499/10* (2013.01)

(58) Field of Classification Search

CPC ..... H04R 1/323; H04R 1/026; H04R 3/00; H04R 3/14; H04R 17/00; H04R 2217/03; H04R 2499/10; H04R 2499/15; H04R 2400/01; H04R 2400/11; B06B 1/06; B06B 1/0607; B06B 1/0622; B06B 1/0692; B06B 1/0696

USPC ..... 381/98, 332, 333, 334

See application file for complete search history.

(56) References Cited

U.S. PATENT DOCUMENTS

| | | | | |
|---|---|---|---|---|
| 6,554,098 | B1 * | 4/2003 | Komura | H04R 1/02 181/173 |
| 6,985,596 | B2 * | 1/2006 | Bank | H04R 7/045 381/152 |
| 7,174,025 | B2 * | 2/2007 | Azima | H04R 7/045 381/152 |
| 10,200,772 | B2 * | 2/2019 | Ahn | G06F 1/1688 |
| 2010/0119080 | A1 * | 5/2010 | Kim | H04R 5/04 381/97 |
| 2015/0341714 | A1 * | 11/2015 | Ahn | H04M 1/03 381/333 |
| 2017/0289661 | A1 * | 10/2017 | Hose | H04R 7/04 |

FOREIGN PATENT DOCUMENTS

| | | | |
|---|---|---|---|
| JP | 2008-022347 | * | 1/2008 |
| JP | 2008-022347 | A | 1/2008 |
| JP | 2008-048312 | A | 2/2008 |

* cited by examiner

*Primary Examiner* — William A Jerez Lora
(74) *Attorney, Agent, or Firm* — Oliff PLC

(57) ABSTRACT

A speaker device according to an embodiment includes a panel, a plurality of vibration elements, and a driving unit. The plurality of vibration elements vibrate the panel. The driving unit applies, to a first vibration element, a first driving signal that includes a modulated wave provided in such a manner that a carrier wave in an ultrasonic wave band is modulated by a sound signal in an audible wave band and applies, to a second vibration element, a second driving signal that includes the carrier wave and is different from the first driving signal, so that a vibrational region is formed on the panel.

5 Claims, 6 Drawing Sheets

| | | MODULATED WAVE / MODULATED WAVE | MODULATED WAVE / CARRIER WAVE |
|---|---|---|---|
| APPLIED VOLTAGE | FIRST VIBRATION ELEMENT | 21.4 Vpp | 17.4 Vpp |
| | SECOND VIBRATION ELEMENT | 21.3 Vpp | 11.4 Vpp |
| CARRIER WAVE SOUND PRESSURE LEVEL | | 133.2 dB (SPL) | 131.9 dB (SPL) |
| DEMODULATED SOUND SOUND PRESSURE LEVEL | | 81.8 dB (SPL) | 85.9 dB (SPL) |

SPEAKER DEVICE AND CONTROL METHOD FOR A SPEAKER DEVICE

CROSS-REFERENCE TO RELATED APPLICATION

This application is based upon and claims the benefit of priority to Japanese Patent Application No. 2017-205652 filed on Oct. 24, 2017, the entire contents of which are herein incorporated by reference.

FIELD

An embodiment of the disclosure relates to a speaker device and a control method for a speaker device.

BACKGROUND

A speaker device has conventionally been known where a plurality of ultrasonic vibrators are arranged in an array shape to have a directivity thereof. Such a speaker device is also called a parametric array speaker and applies an ultrasonic voltage that is modulated by a sound signal in an audible wave band to a plurality of ultrasonic vibration elements so that it is possible to generate an audible sound in a particular direction (see, for example, Japanese Patent Application Publication No. 2008-022347).

For such a speaker that has a so-called narrow directivity, one is also proposed that includes a vibration element in at least one site on a panel-type vibration plate and generates a standing wave on the vibration plate due to vibration of such a vibrator in such a manner that each of antinodes of such a standing wave is a sound radiation unit and radiates a sound wave that has a directivity in a predetermined direction with respect to a panel surface.

Generally, in such a speaker device, a sound pressure level of an audible sound to be output is increased with increasing a voltage that is applied to a vibration element. However, in a speaker device as described above, an applicable voltage is limited from a viewpoint of durability of a vibration element. Accordingly, it is desired that an applied voltage is reduced and a sound pressure level of an audible sound to be output is raised.

SUMMARY

A speaker device according to an aspect of an embodiment includes a panel, a plurality of vibration elements, and a driving unit. The plurality of vibration elements vibrate the panel. The driving unit applies, to a first one of the vibration elements, a first driving signal that includes a modulated wave provided in such a manner that a carrier wave in an ultrasonic wave band is modulated by a sound signal in an audible wave band and applies, to a second one of the vibration elements, a second driving signal that includes the carrier wave and is different from the first driving signal, so that a vibrational region is formed on the panel.

BRIEF DESCRIPTION OF DRAWINGS

More complete recognition of the present invention and an advantage involved therewith could readily be understood when reading the following detailed description of the invention in light of the accompanying drawings.

DESCRIPTION OF EMBODIMENT

Figure 1:
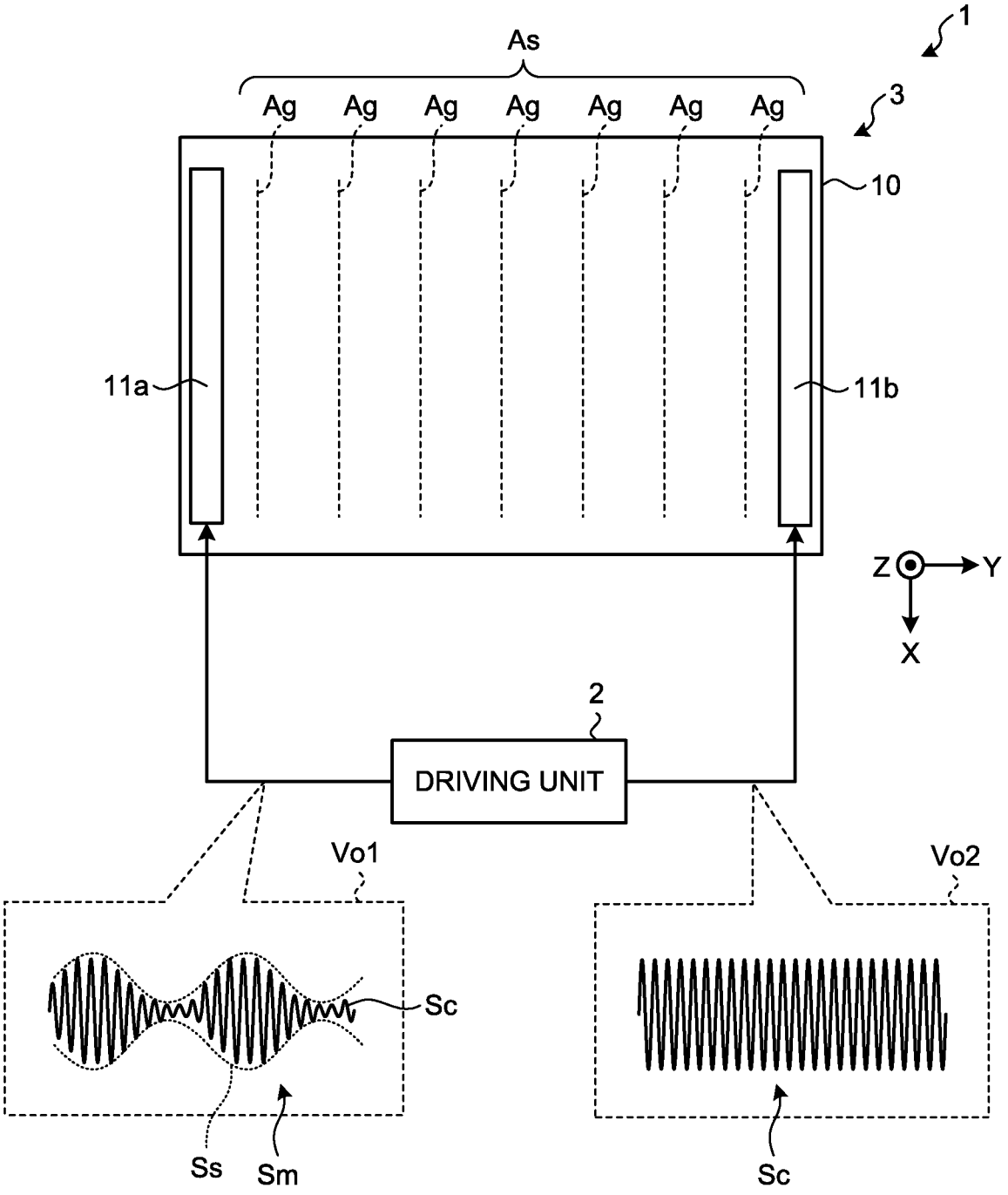
FIG. 1 is a diagram illustrating an outline of a control method for a speaker device according to an embodiment.

Hereinafter, an embodiment of a speaker device and a control method for a speaker device as disclosed in the present application will be explained in detail with reference to the accompanying drawings. Additionally, the present invention is not limited by an embodiment as illustrated below. Furthermore, a plurality of figures that include FIG. 1 are provided with a three-dimensional orthogonal coordinate system that includes a Z-axis with a positive direction that is a front direction of a speaker device, for simplicity of explanation thereof.

First, an outline of a control method for a speaker device according to an embodiment will be explained by using FIG. 1. FIG. 1 is a diagram illustrating an outline of a control method for a speaker device according to an embodiment. FIG. 1 illustrates a front elevation view of a speaker device 1. As illustrated in FIG. 1, the speaker device 1 according to an embodiment includes a driving unit 2 and a sound output unit 3. The sound output unit 3 includes a panel 10 and a plurality of vibration elements 11*a*, 11*b*. The speaker device 1 functions as, for example, a speaker device of an acoustic system that is mounted on a vehicle. Additionally, a target for mounting the speaker device 1 thereon is not limited to an acoustic system of a vehicle and may be an acoustic system that is provided in a facility such as a house.

The panel 10 is a plate-shaped member that vibrates in response to vibration of vibration elements 11, and is formed of a material such as a glass. The vibration elements 11*a*, 11*b* are, for example, piezoelectric elements and provided on both edge parts of the panel 10.

Additionally, both edge parts of the panel 10 are not limiting, and it is sufficient that the vibration elements 11 are arranged in a positional relationship that is capable of forming a standing wave. The driving unit 2 generates driving signals Vo1, Vo2 and applies such driving signals Vo1, Vo2 to the vibration elements 11*a*, 11*b*.

Specifically, the driving unit 2 amplifies a modulated wave Sm where a carrier wave Sc in an ultrasonic wave band is modulated by a sound signal in an audible wave band (less than 20 kHz) and thereby generates a driving signal Vo1 (that will be a first driving signal Vo1 below) that is applied to the vibration element 11*a* (that will be a first vibration element 11*a* below). Furthermore, the driving unit 2 amplifies a carrier wave Sc in an ultrasonic wave band and thereby generates a driving signal Vo2 (that will be a second driving signal Vo2 below) that is applied to the vibration element 11*b* (that will be a second vibration element 11*b* below).

Due to application of driving signals Vo1, Vo2 to the vibration elements 11, the panel 10 vibrates and a standing wave is generated so that a stripe-shaped vibrational region As is formed on the panel 10. A stripe-shaped vibration region As includes a plurality of band-shaped vibrational regions Ag and such band-shaped vibrational regions Ag function as linear sound sources that radiate an ultrasonic wave that is modulated by a sound signal Ss.

In an example as illustrated in FIG. 1, the vibration elements 11 that extend in a transverse direction of the panel 10 (a direction of an X-axis) are provided on both edge parts of the panel 10 in a longitudinal direction thereof (a direction of a Y-axis), respectively. Then, a standing wave is formed in a longitudinal direction of the panel 10 due to vibration of the vibration elements 11 and a plurality of band-shaped vibrational regions Ag that extend in a transverse direction of the panel 10 are formed in a longitudinal direction of the panel 10 at regular intervals.

Such a speaker 1 generates a sound wave dependent on a sound signal in a particular direction, due to mutual interference of ultrasonic waves that are generated from a plurality of band-shaped vibrational regions Ag that are formed as described above and a spontaneous demodulation phenomenon that is caused by non-linear distortion of a modulated ultrasonic wave. Thereby, the speaker 1 functions as a speaker device that has a narrow directivity.

Herein, a conventional speaker device will be explained. A conventional speaker device applies, to all of a plurality of vibration elements, a driving signal that includes a modulated wave where a carrier wave in an ultrasonic wave band is modulated by a sound signal in an audible wave band, so that an audible sound is generated. Furthermore, a sound pressure level of an audible sound to be output generally increases with increasing a voltage that is applied to a vibration element.

However, durability of a vibration element against an applied voltage in a conventional speaker device is limited and a voltage that is capable of being applied thereto is limited, so that it is desired that an applied voltage is reduced and a sound pressure level of an audible sound to be output is raised.

Accordingly, the speaker device 1 according to an embodiment applies different driving signals Vo1, Vo2 to the first vibration element 11*a* and the second vibration element 11*b*. Specifically, the speaker device 1 according to an embodiment applies a first driving signal Vo1 that includes a modulated wave Sm to the first vibration element 11*a* and applies a second driving signal Vo2 that includes a carrier wave Sc to the second vibration element lib.

Due to application of a first driving signal Vo1 and a second driving signal Vo2, the first vibration element 11*a* generates vibration that is caused by a modulated wave Sm whereas the second vibration element 11*b* generates vibration that is caused by an unmodulated carrier wave Sc. That is, a modulated wave Sm and a carrier wave Sc are combined on the panel 10.

Thereby, it is possible to reduce a voltage for maintaining a sound pressure level of a conventional speaker device. Specifically, a modulated wave Sm and a carrier wave Sc are combined so that a sound pressure level in a partial frequency band of an audible sound to be generated is higher than that of an audible sound of a conventional speaker device (see FIG. 6).

That is, it is possible for the speaker device 1 according to an embodiment to apply a first driving signal Vo1 and a second driving signal Vo2 that are different from one another and thereby reduce a voltage to be applied without reducing a conventional sound pressure level. Accordingly, it is possible to provide a sound pressure level that is greater than a conventional one, in a case where a maximum voltage is applied within a range of durability of the vibration elements 11*a*, 11*b*. That is, it is possible to reduce an applied voltage and raise a sound pressure level of an audible sound to be output.

Additionally, although a case where a second driving signal Vo2 includes only an unmodulated carrier wave Sc is illustrated in an example as illustrated in FIG. 1, it is sufficient that a first driving signal Vo1 differs therefrom and a second driving signal Vo2 may include, for example, a part of a sound signal Ss (for example, a part of the first driving signal Vo1).

Figure 2:
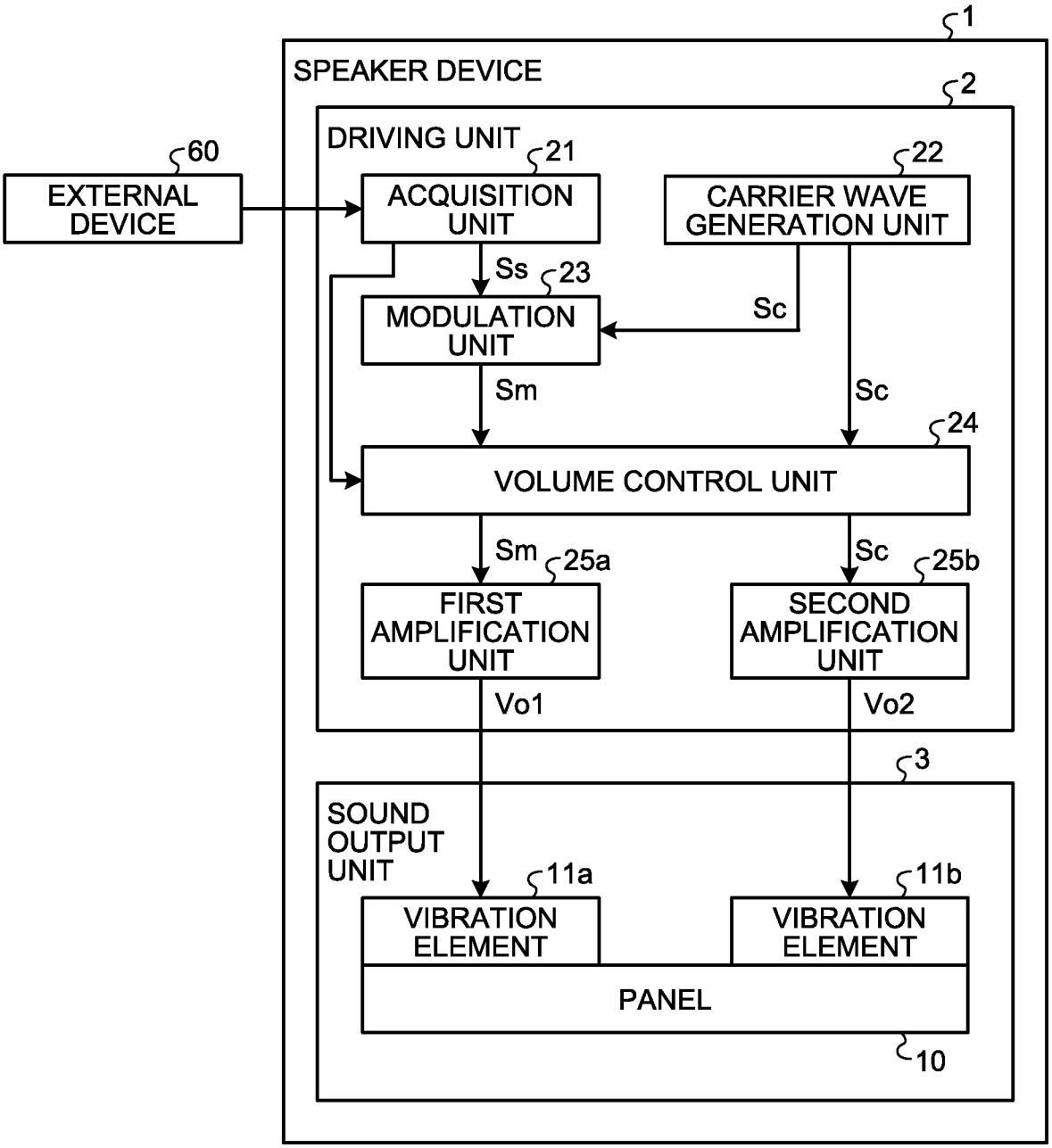
FIG. 2 is a block diagram of a speaker device according to an embodiment.

Next, a configuration of the speaker device 1 according to an embodiment will further be explained by using FIG. 2. FIG. 2 is a block diagram of the speaker device 1 according to an embodiment. As illustrated in FIG. 2, the speaker device 1 is connected to an external device 60 and vibrates the panel 10 based on a sound signal Ss that is input from the external device 60 so that an ultrasonic wave dependent on a carrier wave Sc that is modulated by the sound signal Ss is generated.

The external device 60 is a device that outputs a sound signal Ss in an audible wave band (a band that is less than 20 kHz) to the speaker device 1 and is, for example, a device that is capable of outputting such a sound signal Ss to an exterior, such as an audio device, a car navigation device, a smartphone, or a Personal Computer (PC).

Furthermore, the speaker device 1 includes a driving unit 2 and a sound output unit 3. The driving unit 2 includes an acquisition unit 21, a carrier wave generation unit 22, a modulation unit 23, a volume control unit 24, a first amplification unit 25*a*, and a second amplification unit 25*b*. The sound output unit 3 includes a panel 10 and vibration elements 11*a*, 11*b*.

The driving unit 2 includes, for example, a computer that has a Central Processing Unit (CPU), a Read Only Memory (ROM), a Random Access Memory (RAM), a Hard Disk Drive (HDD), an input/output port, and the like, and a variety of circuits such as an amplification circuit.

A CPU of a computer reads and executes, for example, a variety of programs that are stored in a ROM, and thereby, functions as the acquisition unit 21, the carrier wave generation unit 22, the modulation unit 23, and the volume control unit 24 of the driving unit 2. Furthermore, it is also possible to compose at least one or all of the acquisition unit 21, the carrier wave generation unit 22, the modulation unit 23, and the volume control unit 24 of the driving unit 2 of hardware such as an Application Specific Integrated Circuit (ASIC) or a Field Programmable Gate Array (FPGA). Furthermore, the first amplification unit 25*a* and the second amplification unit 25*b* are composed of, for example, amplification circuits such as power amplifiers.

The acquisition unit 21 acquires a sound signal Ss that is output from the external device 60 and outputs the acquired sound signal Ss to the modulation unit 23. Additionally, it is also possible for the acquisition unit 21 to control a gain (amplitude) of a sound signal Ss and output a sound signal Ss after such control to the modulation unit 23. Furthermore, the acquisition unit 21 may have a low-pass filter that passes a signal in an audible wave band, and it is possible for such a low-pass filter to eliminate a signal outside such an audible wave band.

The carrier wave generation unit 22 generates, and outputs to the modulation unit 23 and the volume control unit 24, a carrier wave Sc. A carrier wave Sc is a sine wave signal in an ultrasonic wave band and has a frequency to generate a standing wave on the panel 10 and form a stripe-shaped vibrational region As thereon.

The modulation unit 23 generates, and outputs to the volume control unit 24, a modulated wave Sm that is a signal provided in such a manner that a carrier wave Sc that is input from the carrier wave generation unit 22 is modulated by a sound signal Ss that is input from the acquisition unit 21. Modulation that is executed by the modulation unit 23 is executed by means of Amplitude Modulation (AM) modulation or Frequency Modulation (FM) modulation. Additionally, AM modulation is, for example, Double Sideband (DSB) modulation or Single Sideband (SSB) modulation.

The volume control unit 24 controls a gain of a modulated wave Sm that is input from the modulation unit 23 depending on a volume signal that is input from the acquisition unit 21, so that a sound pressure level (a volume) that is output from the panel 10 is controlled.

Furthermore, the volume control unit 24 controls a gain of a carrier wave Sc that is input from the carrier wave generation unit 22 depending on a volume signal that is input from the acquisition unit 21 so that a sound pressure level that is output from the panel 10 is controlled.

A modulated wave Sm that is output from the volume control unit 24 to the first amplification unit 25*a* is amplified by the first amplification unit 25*a* and applied to the first vibration element 11*a* as a first driving signal Vo1 of an alternating-current voltage dependent on a waveform of such a modulated wave Sm.

Furthermore, a carrier wave Sc that is output from the volume control unit 24 to the second amplification unit 25*b* is amplified by the second amplification unit 25*b* and applied to the second vibration element 11*b* as a second driving signal Vo2 of an alternating-current voltage dependent on a waveform of such a carrier wave Sc.

The first vibration element 11*a* and the second vibration element 11*b* are arranged on both edge parts of the panel 10 in a longitudinal direction thereof one by one. That is, the first vibration element 11*a* and the second vibration element 11*b* are provided as a pair thereof. Thereby, it is possible to vibrate a whole of the panel 10 at a minimal number of vibration elements. Furthermore, the first vibration element 11*a* and the second vibration element 11*b* stretch depending on a first driving signal Vo1 and a second driving signal Vo2 that are applied thereto so that a standing wave is generated on the panel 10. An antinode of such a standing wave is a band-shaped vibrational region Ag.

The panel 10 is a rectangular plate-type member that vibrates depending on vibration of the vibration elements 11 and is formed of, for example, a material such as a glass, where a glass is not limiting and it is also possible to use another member such as a metalic or a plastic one.

As described above, the vibration elements 11*a*, lib are piezoelectric elements where it is sufficient that a configuration thereof is provided in such a manner that it is possible to vibrate at frequencies of driving signals Vo1, Vo2 that are supplied from the driving unit 2, and a vibration element other than a piezoelectric element may be provided.

Figure 3:
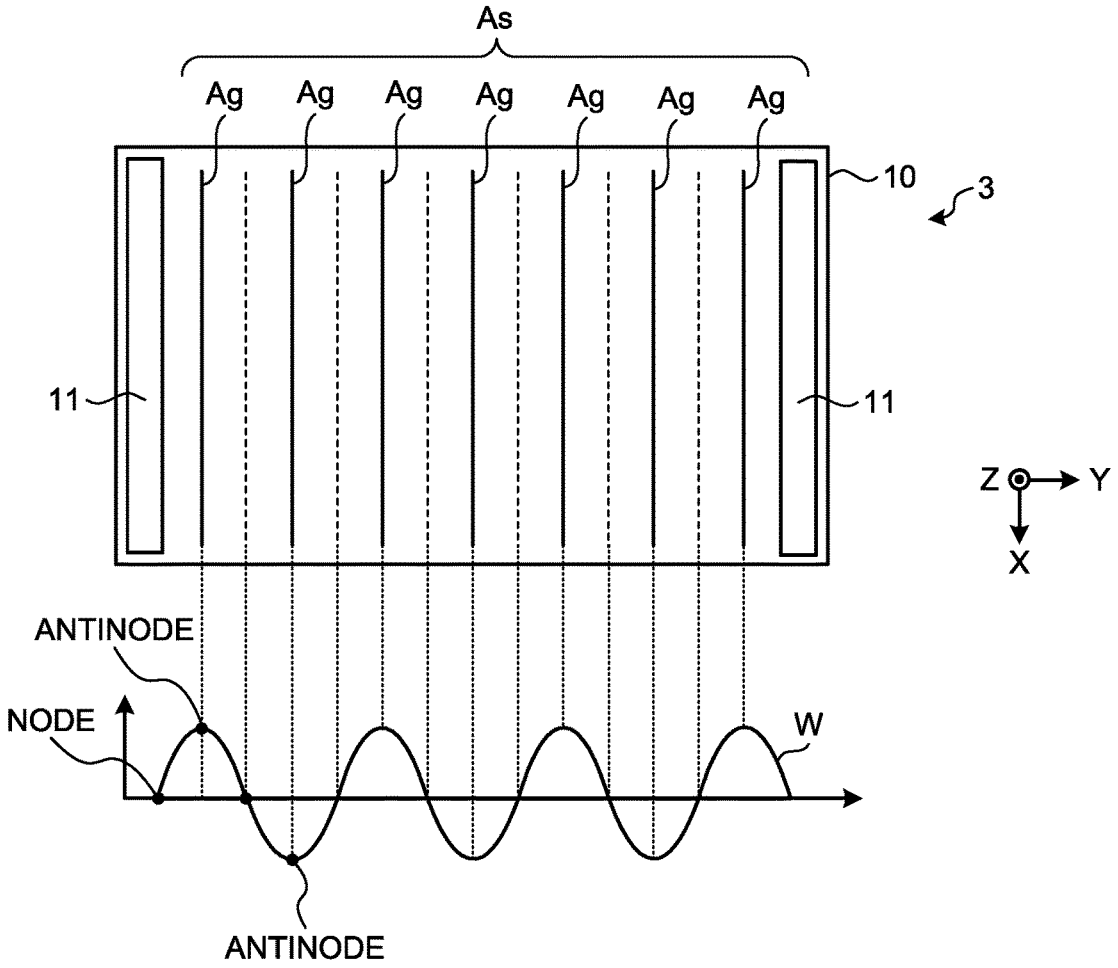
FIG. 3 is a diagram illustrating a relationship between a band-shaped vibrational region and a standing wave that are formed on a panel.

FIG. 3 is a diagram illustrating a relationship between a band-shaped vibrational region Ag and a standing wave that are formed on the panel 10. In FIG. 3, a solid line indicates an antinode of a standing wave W and a broken line indicates a node of the standing wave W, where an antinode part of the standing wave W functions as a band-shaped vibrational region Ag. An antinode part of a standing wave W is generated at regular intervals in a longitudinal direction of the panel 10, and hence, a band-shaped vibrational region Ag is generated at regular intervals in a longitudinal direction of the panel 10 (a direction of a Y-axis). Additionally, although FIG. 3 illustrates, for simplicity of an explanation, an example where seven band-shaped vibrational regions Ag are generated in a longitudinal direction of the panel 10 by a standing wave W, the number of band-shaped vibrational regions Ag is not limited to seven, and further, is capable of being increased with increasing a frequency of a carrier wave Sc.

Figure 4:
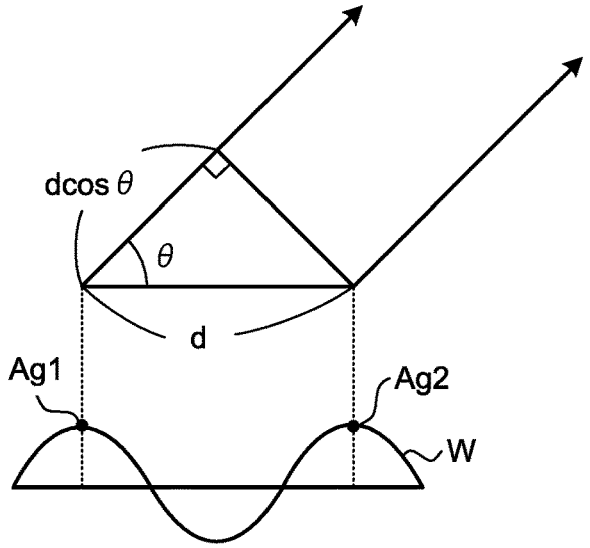
FIG. 4 is a diagram for explaining a relationship between a standing wave that is formed on a panel and a directivity of a speaker device.

Next, a directivity of the speaker device 1 will be explained. FIG. 4 is a diagram for explaining a relationship between a standing wave W that is formed on the panel 10 and a directivity of the speaker device 1. FIG. 4 partially illustrates a standing wave W for simplicity of an explanation. Furthermore, adjacent antinodes with equal phases in a standing wave W are referred to as band-shaped vibrational regions Ag1, Ag2 and an angle θ of ultrasonic waves that are generated at band-shaped vibrational regions Ag1, Ag2 with respect to the panel 10 is indicated.

For an arbitrary angle θ, phases of ultrasonic waves that are generated at band-shaped vibrational regions Ag1, Ag2 differs by distance d cos θ. As λ is a wavelength of a carrier wave Sc, ultrasonic waves that are generated at band-shaped vibrational regions Ag1, Ag2 cancel one another at an angle θ where distance d cos θ is an odd multiple of wavelength λ/2. That is, ultrasonic waves are canceled at an angle θ where distance d cos θ is an odd multiple of wavelength λ/2. On the other hand, at an angle θ where distance d cos θ is an integral multiple of wavelength λ (an even multiple of wavelength λ/2), ultrasonic waves that are generated at band-shaped vibrational regions Ag1, Ag2 enhance one another. Then, a sound wave in an audible wave band is generated due to a spontaneous demodulation phenomenon that is caused by non-linear distortion of an ultrasonic wave in a case where an ultrasonic wave propagates through a space or a case where an ultrasonic wave reflects from an object.

Thus, ultrasonic waves that are generated from a plurality of band-shaped vibrational regions Ag cause phase interference (enhancement and cancelation) thereof so that it is possible to cause ultrasonic waves to travel in a particular direction. Then, a sound wave in an audible wave band is generated due to a spontaneous demodulation phenomenon that is caused by non-linear distortion of an ultrasonic wave, so that it is possible for the speaker device 1 to have a narrow directivity in a particular direction.

Figures 5, 6:
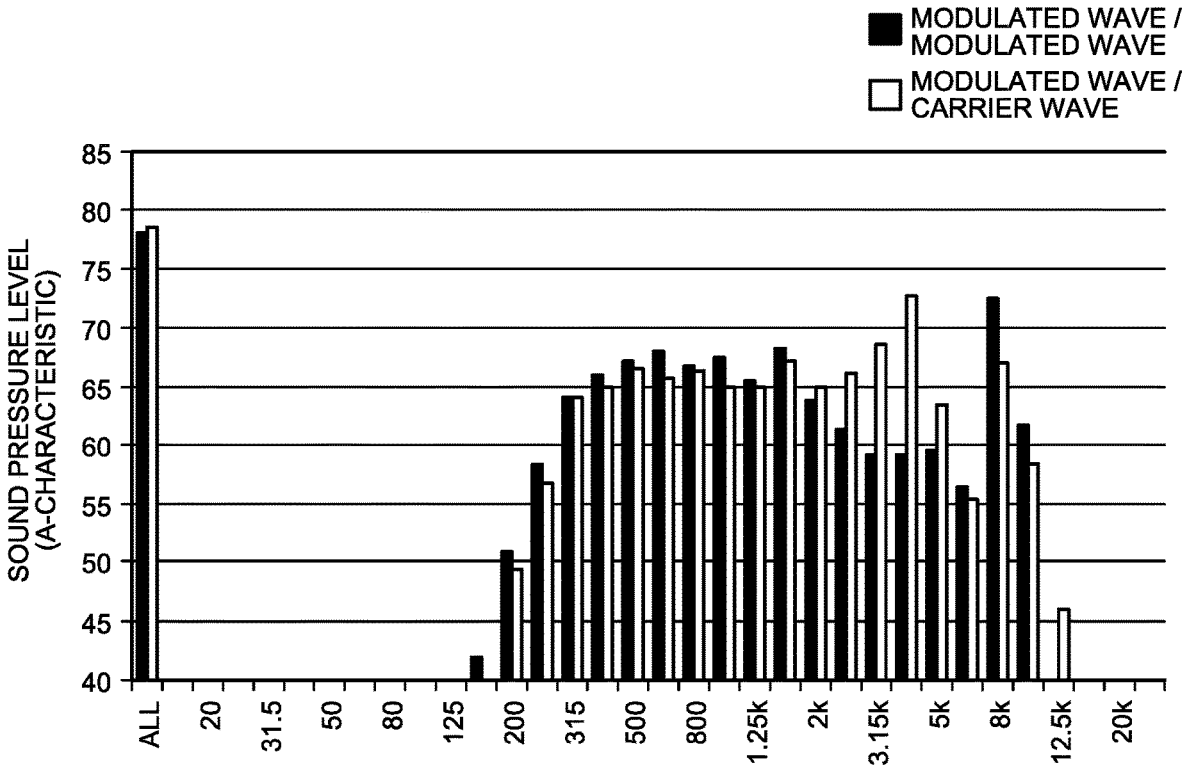
FIG. 5 is a diagram illustrating a result of measurement of a sound pressure level of a speaker device according to an embodiment.
FIG. 6 is a diagram illustrating a result of measurement of a sound pressure level of a speaker device according to an embodiment.

Next, a result of measurement of a sound pressure level of the speaker device 1 will be explained. FIG. 5 and FIG. 6 are diagrams illustrating a result of measurement of a sound pressure level of the speaker device 1 according to an embodiment. FIG. 5 illustrates a result of measurement in a case where a sine wave with 2 kHz is reproduced as a sound signal Ss. FIG. 5 and FIG. 6 illustrate a case where both a first driving signal Vo1 and a second driving signal Vo2 are modulated waves Sm ("MODULATED WAVE/MODULATED WAVE" in the figures) and a case where a first driving signal Vo1 is a modulated wave Sm and a second driving signal Vo2 is only a carrier wave Sc ("MODULATED WAVE/CARRIER WAVE" in the figures).

Furthermore, FIG. 6 illustrates a result of measurement in a case where a band-limited signal provided in such a manner that a bandpass filter is applied to a pink noise with a power that is inversely proportional to a frequency is reproduced as a sound signal Ss. Furthermore, in FIG. 5 and FIG. 6, a measurement point for a sound pressure level is provided at a position that is a predetermined distance away from the panel 10 in a front direction (a positive direction of a Z-axis).

First, a result of measurement in a case where a sine wave with 2 kHz is reproduced will be explained by using FIG. 5. As illustrated in FIG. 5, in "MODULATED WAVE/MODULATED WAVE", a driving signal Vo with 21.4 Vpp is applied to the first vibration element 11*a* and a driving signal Vo with 21.3 Vpp is applied to the second vibration element 11*b*. As a result, a sound pressure level of a carrier wave Sc is 133.2 dB and a sound pressure level of a demodulated sound (a sound signal Ss) is 81.8 dB. Additionally, a carrier wave Sc is not provided in an audible sound band, and hence, a sound thereof is not perceived by a human ear.

Furthermore, in "MODULATED WAVE/CARRIER WAVE", a first driving signal Vo1 with 17.4 Vpp is applied to the first vibration element 11*a* and a second driving signal Vo2 with 11.4 Vpp is applied to the second vibration element lib. As a result, a sound pressure level of a carrier wave Sc is 131.9 dB and a sound pressure level of a demodulated sound (a sound signal Ss) is 85.9 dB.

That is, an applied voltage that is needed to provide a comparable sound pressure level of a demodulated sound in "MODULATED WAVE/CARRIER WAVE" is less than that in "MODULATED WAVE/MODULATED WAVE". That is, it is possible for the speaker device 1 according to an embodiment to decrease an applied voltage without decreasing a sound pressure level.

Next, a result of measurement in a case where a band-limited pink noise is reproduced will be explained by using FIG. 6. In FIG. 6, a vertical axis indicates an A-characteristic sound pressure level at 48 kHz sampling and a horizontal axis indicates a frequency band of a demodulated sound. Additionally, "ALL" at a left edge of a graph indicates an A-characteristic average sound pressure level. Additionally, an applied voltage in "MODULATED WAVE/CARRIER WAVE" is less than that in "MODULATED WAVE/MODULATED WAVE", although FIG. 6 omits illustration thereof.

As illustrated in FIG. 6, "ALL", namely, an average sound pressure level in "MODULATED WAVE/CARRIER WAVE" is substantially comparable with that in "MODULATED WAVE/MODULATED WAVE". That is, even for a demodulated sound where a plurality of frequencies are mixed therein, such as a pink noise, it is possible to decrease an applied voltage without decreasing a sound pressure level similarly to a sine wave with 2 kHz.

Moreover, as a sound pressure level for each frequency band in 200 Hz to 12.5 kHz is viewed, a sound pressure level at 2 kHz or higher in "MODULATED WAVE/CARRIER WAVE" is comparatively greater than that in "MODULATED WAVE/MODULATED WAVE". In particular, in 2 kHz to 5 kHz, "MODULATED WAVE/CARRIER WAVE" is significantly greater than "MODULATED WAVE/MODULATED WAVE".

That is, from a result of FIG. 6, a frequency band in 2 kHz to 5 kHz is reduced in "MODULATED WAVE/MODULATED WAVE" whereas a frequency band in 2 kHz to 5 kHz is not reduced but is left in "MODULATED WAVE/CARRIER WAVE". That is, a frequency band in 2 kHz to 5 kHz is not reduced but is left in "MODULATED WAVE/CARRIER WAVE", so that it is possible to raise a whole of a sound pressure level.

As has been described above, the speaker device 1 according to an embodiment includes the panel 10, the plurality of vibration elements 11*a*, 11*b*, and the driving unit 2. The plurality of vibration elements 11*a*, 11*b* vibrate the panel 10. The driving unit 2 applies, to the first vibration element 11*a*, a first driving signal Vo1 that includes a modulated wave Sm where a carrier wave Sc in an ultrasonic wave band is modulated by a sound signal Ss in an audible wave band and applies, to the second vibration element 11*b*, a second driving signal Vo2 that includes the carrier wave Sc and is different from the first driving signal Vo1, so that a vibrational region As is formed on the panel 10. Thereby, it is possible to reduce an applied voltage and raise a sound pressure level of an audible sound to be output.

Additionally, although the modulation unit 23 in the embodiment as described above outputs a modulated wave Sm directly, that is, a modulated wave Sm that includes a carrier wave Sc and sound signals Ss in both side bands, one side band may be eliminated, for example. Such a point will be explained by using FIG. 7 and FIG. 8.

Figure 7:
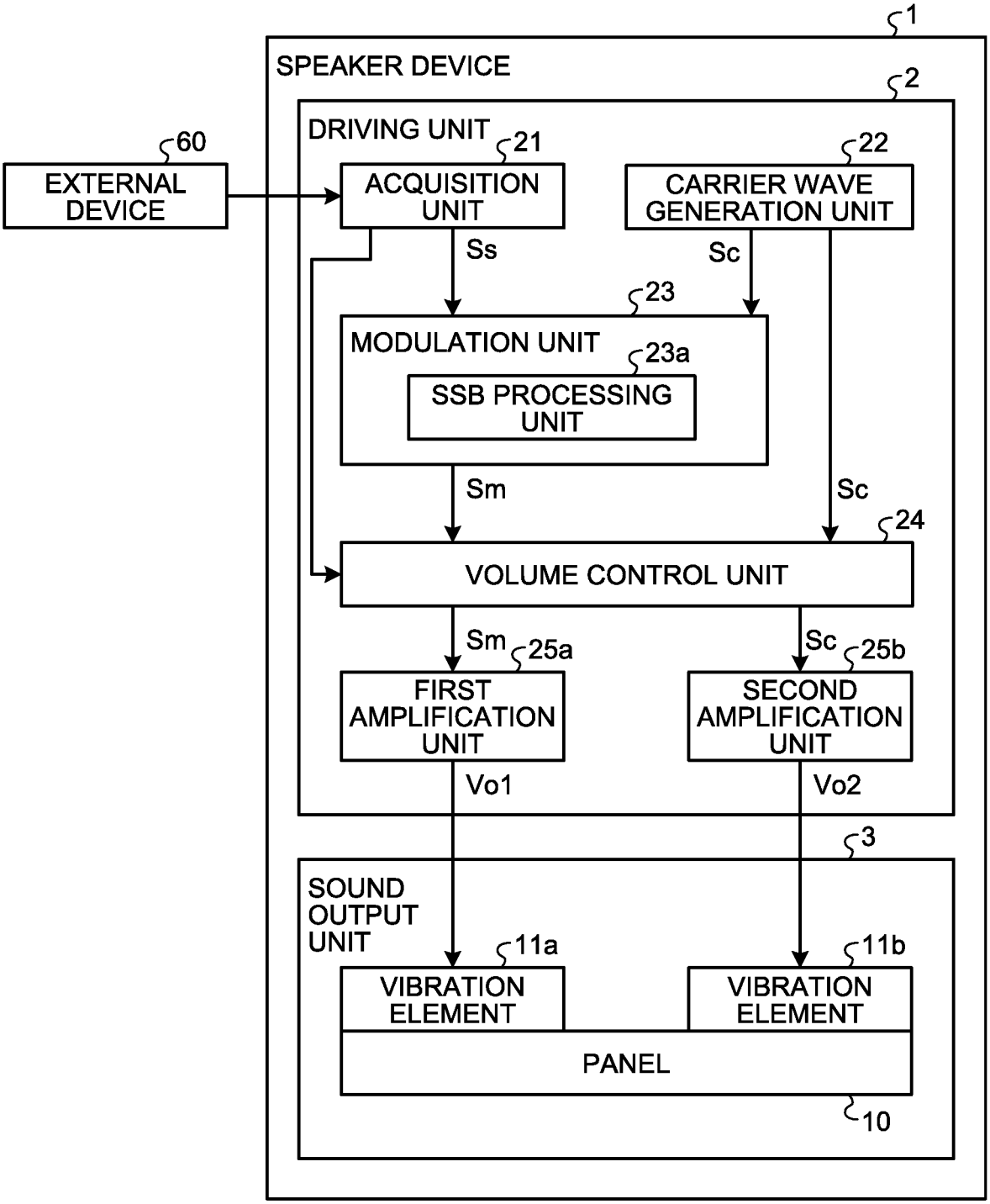
FIG. 7 is a block diagram of a speaker device according to a variation.
Figure 8:
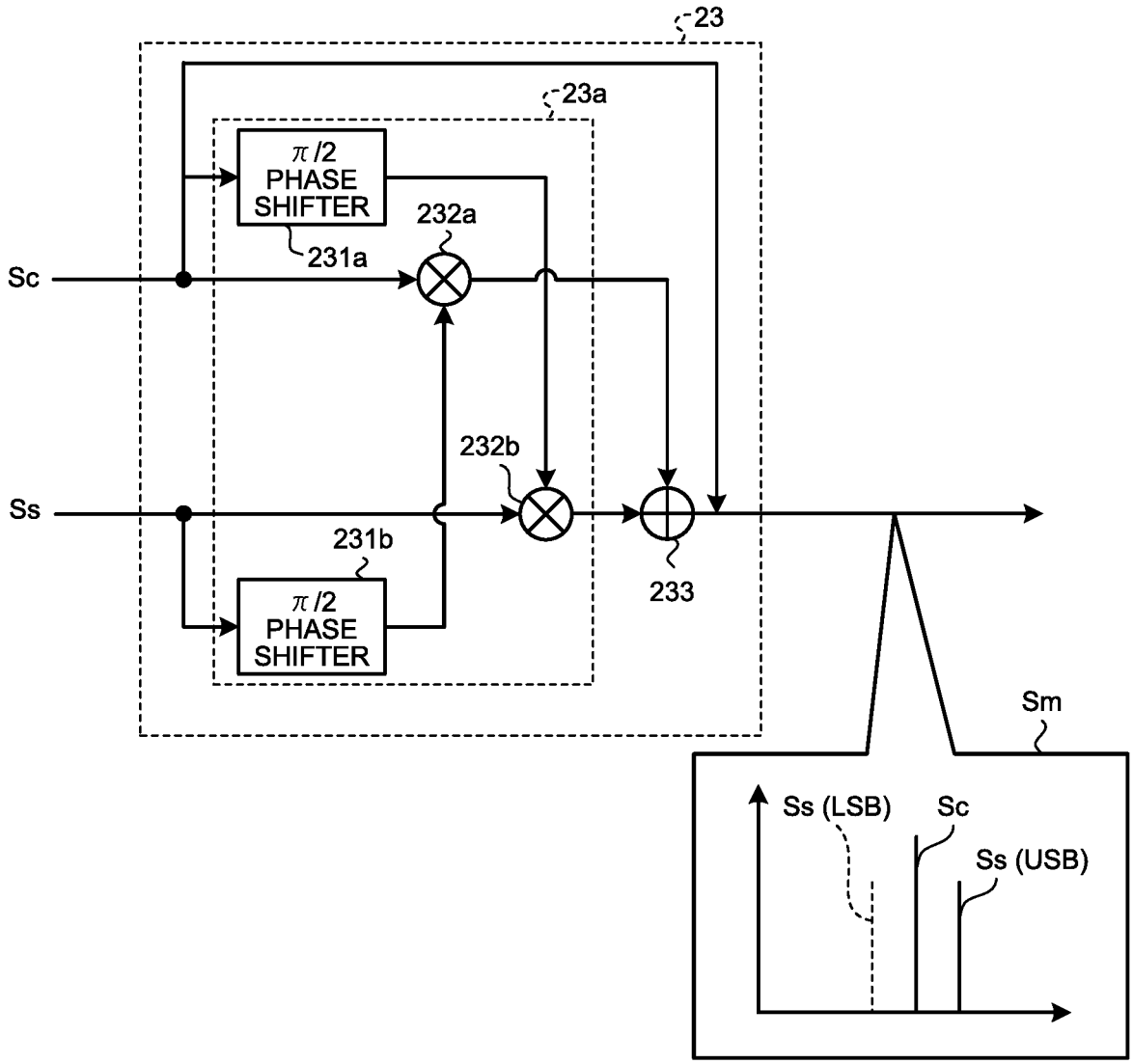
FIG. 8 is diagram illustrating a content of a process of a modulation unit according to a variation.

FIG. 7 is a block diagram of the speaker device 1 according to a variation. FIG. 8 is a diagram illustrating a content of a process of the modulation unit 23 according to a variation. A variation as illustrated below is different from an embodiment as described above in that an SSB processing unit 23*a* is further included.

Specifically, as illustrated in FIG. 7, the modulation unit 23 further includes an SSB processing unit 23*a*. The SSB processing unit 23*a* reduces one side band among both side bands of a sound signal Ss. A content of processing of the modulation unit 23 that includes the SSB processing unit 23*a* will be explained by using FIG. 8.

As illustrated in FIG. 8, the modulation unit 23 includes the SSB processing unit 23*a* and an addition unit 233. The SSB processing unit 23*a* includes two $\pi/2$ phase shifters 231*a*, 231*b* and two multiplication units 232*a*, 232*b*.

As illustrated in FIG. 8, first, a carrier wave Sc and a sound signal Ss are input to the modulation unit 23 and input to the multiplication units 232*a*, 232*b*, respectively. Furthermore, a carrier wave Sc and a sound signal Ss are input to the $\pi/2$ phase shifters 231*a*, 231*b*, respectively, output therefrom in a state where phases thereof are delayed by $\pi/2$, and input to the multiplication units 232*a*, 232*b*.

A first modulated wave Sm is generated from a carrier wave Sc with a phase that is not delayed and a sound signal Ss with a phase that is delayed by $\pi/2$ in the multiplication unit 232*a* and input to the addition unit 233. Furthermore, a second modulated wave Sm is generated from a carrier wave Sc with a phase that is delayed by $\pi/2$ and a sound signal Ss with a phase that is not delayed in the multiplication unit 232*b* and input to the addition unit 233.

Then, the addition unit 233 applies an addition operation to a first modulated wave Sm and a second modulated wave Sm to generate a signal where a lower side band (LSB) of a sound signal Ss and a carrier wave Sc are eliminated. Then, a carrier wave Sc is added to a signal that is generated by the addition unit 233, so that a modulated wave Sm that includes only an upper side band (USB) of a sound signal Ss is generated and output. Thus, one side band is eliminated, so that it is possible to further improve efficiency in a case where an ultrasonic wave is demodulated into an audible sound.

Additionally, although a lower side band of a sound signal Ss is completely eliminated in an example as illustrated in FIG. 8, this is not limiting and a part of a lower side band may be eliminated to generate a modulated wave Sm in a state where the lower side band is reduced more than an upper side band. Furthermore, although a lower side band of a sound signal Ss is eliminated, this is not limiting and an upper side band may be eliminated to generate a modulated wave Sm with a lower side band that is left therein.

Embodiment (1) is a speaker device, including a panel, a plurality of vibration elements that vibrate the panel, and a driving unit that applies, to a first one of the vibration elements, a first driving signal that includes a modulated wave provided in such a manner that a carrier wave in an ultrasonic wave band is modulated by a sound signal in an audible wave band and applies, to a second one of the vibration elements, a second driving signal that includes the carrier wave and is different from the first driving signal, so that a vibrational region is formed on the panel.

Embodiment (2) is the speaker device according to Embodiment (1), wherein the driving unit applies, to the first vibration element, the first driving signal that includes the modulated wave where one side band among both side bands of the carrier wave that correspond to the sound signal is reduced.

Embodiment (3) is the speaker device according to Embodiment (1), wherein the driving unit applies only the carrier wave as the second driving signal to the second vibration element.

Embodiment (4) is the speaker device according to Embodiment (1), wherein the panel is a rectangular flat plate, and the vibration elements are provided as a pair thereof and arranged on both edge parts of the panel in a longitudinal direction thereof, respectively.

Embodiment (5) is a control method for a speaker device that includes a panel, and a plurality of vibration elements that vibrate the panel, wherein the control method for a speaker device includes a driving step that applies, to a first one of the vibration elements, a first driving signal that includes a modulated wave provided in such a manner that a carrier wave in an ultrasonic wave band is modulated by a sound signal in an audible wave band and applies, to a second one of the vibration elements, a second driving signal that includes the carrier wave and is different from the first driving signal, so that a vibrational region is formed on the panel.

It is possible for a person(s) skilled in the art to readily derive an additional effect or variation. Hence, a broader aspect of the present invention is not limited to a specific detail or representative embodiment illustrated or described above. Therefore, it is possible to provide a variety of modifications without deviating from a spirit or scope of a general inventive concept that is defined by the accompanying claim(s) and an equivalent(s) thereof.

What is claimed is:

1. A speaker device, comprising:

a panel;

a first vibration element and a second vibration element that vibrate the panel; and a driving unit that applies, to the first vibration element, a first driving signal that includes a modulated wave provided in such a manner that a carrier wave in an ultrasonic wave band is modulated by a sound signal in an audible wave band and applies, to the second vibration element, a second driving signal that includes the carrier wave and is different from the first driving signal, so that a plurality of band-shaped vibrational regions are formed on the panel, wherein an audible sound wave that has directivity in a specific direction is generated as a result of interference of ultrasonic waves that are emitted from the plurality of band-shaped vibrational regions.

2. The speaker device according to claim 1, wherein the driving unit applies, to the first vibration element, the first driving signal that includes the modulated wave where one side band among both side bands of the carrier wave that correspond to the sound signal is reduced.

3. The speaker device according to claim 1, wherein the driving unit applies only the carrier wave as the second driving signal to the second vibration element.

4. The speaker device according to claim 1, wherein the panel is a rectangular flat plate, and the first vibration element and the second vibration element are provided as a pair thereof and arranged on both edge parts of the panel in a longitudinal direction thereof, respectively.

5. A control method for a speaker device, comprising:

vibrating a panel by a first vibration element and a second vibration element; and applying, to the first vibration element, a first driving signal that includes a modulated wave provided in such a manner that a carrier wave in an ultrasonic wave band is modulated by a sound signal in an audible wave band and applying, to the second vibration element, a second driving signal that includes the carrier wave and is different from the first driving signal, so that a plurality of band-shaped vibrational regions are formed on the panel, wherein an audible sound wave that has directivity in a specific direction is generated as a result of interference of ultrasonic waves that are emitted from the plurality of band-shaped vibrational regions.

* * * * *